US005111560A

United States Patent [19]

Sato

[11] Patent Number: 5,111,560

[45] Date of Patent: May 12, 1992

[54] AUTOMATIC WARP THREADING APPARATUS

[75] Inventor: Takumi Sato, Tachikawa, Japan

[73] Assignee: Kabushiki Kaisha Nishiki, Osaka, Japan

[21] Appl. No.: 348,663

[22] PCT Filed: Aug. 4, 1988

[86] PCT No.: PCT/JP88/00775

§ 371 Date: Sep. 21, 1990

§ 102(e) Date: Sep. 21, 1990

[87] PCT Pub. No.: WO89/01066

PCT Pub. Date: Feb. 9, 1989

[30] Foreign Application Priority Data

Aug. 4, 1987 [JP] Japan ..... 62-195714

[51] Int. Cl.[5] ..... D03J 1/14

[52] U.S. Cl. ..... 28/204; 28/203.1; 28/205; 28/206; 28/207

[58] Field of Search ..... 28/203, 204, 205, 206, 28/207

[56] References Cited

U.S. PATENT DOCUMENTS 4,499,638 2/1985 John et al. ..... 28/207

4,543,696 10/1985 John et al. ..... 28/206

4,723,346 2/1988 Tachibana et al. ..... 28/206

4,748,568 5/1988 Tobler ..... 28/204

4,894,893 1/1990 Okuda ..... 28/204

*Primary Examiner*—Werner H. Schroeder

*Assistant Examiner*—Bibhu Mohanty

*Attorney, Agent, or Firm*—Gifford, Groh, Sprinkle, Patmore and Anderson

[57] ABSTRACT

The technical field of the present invention relates to an apparatus for automatically threading a warp through the eye of a heddle. In a conventional automatic warp threading apparatus, a drawing-in needle equipped with a hook is delivered out through the eye and is pulled back after hooking the warp so as to thread the warp through the eye. For this reason, the eye is likely to be damaged and a defect is likely to occur during weaving. The automatic warp threading apparatus of the present invention warp threading apparatus of the present invention clamps the warp (Y) with finger members (18, 18') disposed on a thread feeder (5) and a jet nozzle (20) fitted to the finger members (18, 18') ejects a gas so as to thread the clamped warp (Y) through the eye. Accordingly, the eye is not damaged and weaving can be made advantageously.

8 Claims, 4 Drawing Sheets

AUTOMATIC WARP THREADING APPARATUS

TECHNICAL FIELD

This invention relates to an automatic warp threading apparatus for automatically threading warps through the eyes of heddles from one side of a row of multiple parallel heddles.

BACKGROUND ART

An operation for threading warps through the eyes of heddles in a weaving machine has heretofore been carried out manually one warp after another by a skilled worker using a spatula. This manual warp threading operation, however, needs a great deal of perseverance and is inefficient. For this reason, automatic warp threading apparatus have been diffusing in recent years.

One example of such automatic warp threading apparatus is shown in FIG. 7 (perspective view) which is described in Utility Model Publication Kokai No. 53-64760.

In this apparatus, warps Y are drawn from a beam 52 supported on a carriage frame 51, and are stretched between an upper harness rail 53 and a lower harness rail 54. A drive and control box 56 is mounted on a machine frame 55 parallel to the carriage frame 51. By operating various parts contained in this drive and control box, selection of warps Y and selection of heddles H and drop wires D are effected, and the warps are drawn in through the eyes of the heddles H and drop wires D and a reed R.

This warp threading apparatus has a drawing-in needle 57 formed of an elastic metal strap and wound into a drum 58, which needles springs out in a tangential direction of the drum 58 for a drawing action, moves through the eye of a heddle, hooks a warp selected and separated from the group of warps, and returns into the drum, thereby to effect threading.

With this automatic warp threading apparatus, however, the drawing-in needle having a hook reciprocates through the eye of a heddle, wherefore the eye of a heddle is likely to be damaged by the drawing-in needle. When the eye of a heddle is damaged, the thread becomes caught by the damaged part and breaks during a weaving operation. This results in a reduced weaving efficiency and an increased possibility of producing defective goods due to flaws in the material. There will occur further problems that the heddles have a reduced durability and the apparatus involves a high running cost.

Moreover, since the long drawing-in needle is passed through the narrow eyes, drawing-in errors, namely collisions of the forward end of the needle with the eyes of the heddles, tend to take place. Thus there is also the problem of damage occurring wherein the hook at the forward end of the needle becomes bent.

DISCLOSURE OF INVENTION

In order to solve the above-noted problems of the prior art, an automatic warp threading apparatus according to the present invention as set forth in the introduction hereof is characterized in that a thread path table, a stationary base and a thread feed table movable on the stationary base are disposed at one side of the row of heddles, the thread feed table carrying a thread feeder, the thread feeder including finger members for holding the warps arranged on said thread path table, and a jet nozzle is attached to the finger members for ejecting a gas.

Its function and effect are as follows:

In the automatic warp threading apparatus according to the present invention, warps wound on a beam are arranged on the thread path table, a warp is clamped by the finger members attached to the thread feeder, the clamped warp is moved to a position immediately in front of the eye of a heddle, and the jet nozzle attached to the finger members ejects air or other gas flows, thereby to pass the warp through the eye of the heddle.

Thus, the automatic warp threading apparatus of this invention does not damage the most valuable eye of the heddle by inserting the drawing-in needle directly into the eye of the heddle as in the apparatus according to the prior art. This allows extended life of the heddle, eliminates thread breakage due to the damage of the eye of the heddle, promotes weaving efficiency, reduces defective goods, and further reduces threading errors, thereby to produce the effect of leading to a marked improvement in the efficiency of threading operations.

Since the warp is threaded through the eye of the heddle by means of the jet nozzle, compressed air available through pipings in a factory or the like may readily be used as a jet gas. Thus the apparatus involves a reduced installation cost.

BEST MODE FOR CARRYING OUT THE INVENTION

FIG. 1 to FIG. 6 show one embodiment of automatic warp threading apparatus according to the present invention.

Figure 1:
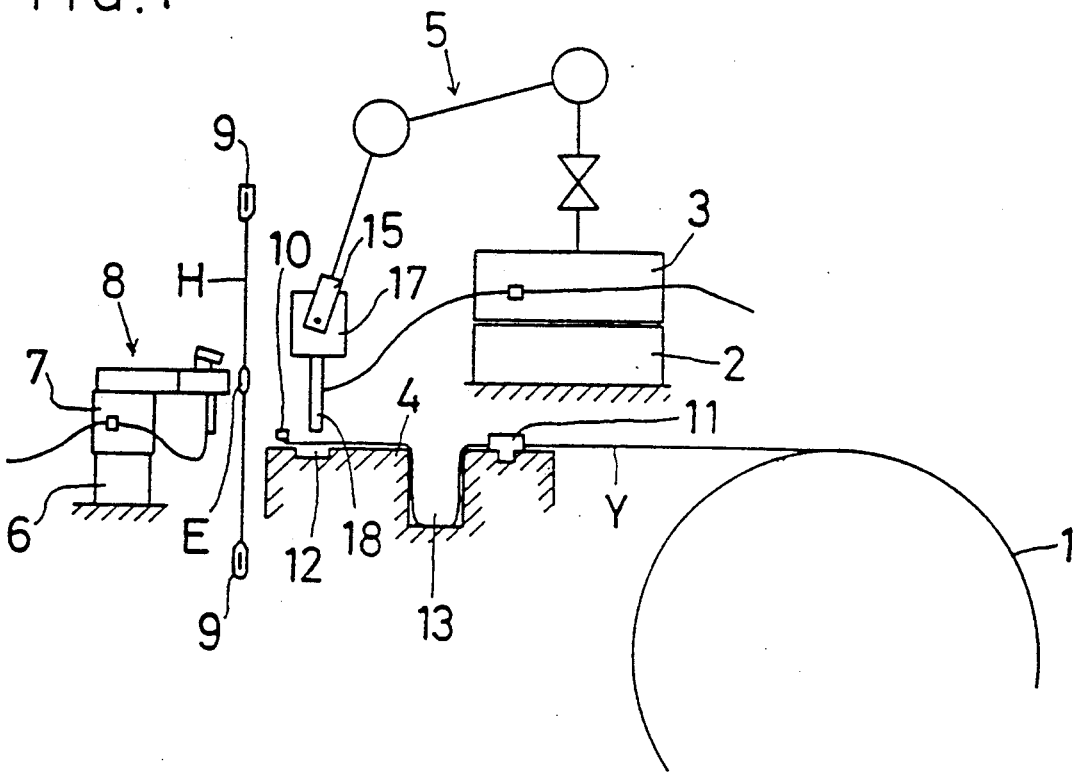
FIG. 1 and FIG. 2 are schematic views showing an embodiment of the present invention and illustrating a threading operation thereof.
Figure 2:
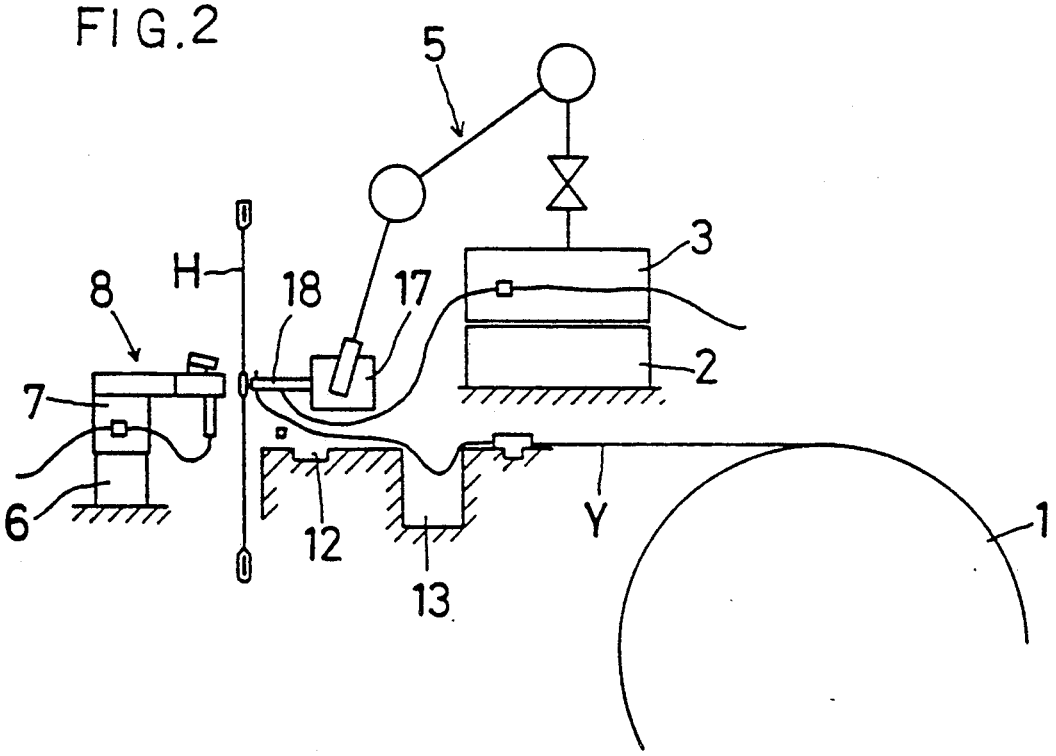

As shown in FIG. 1 and FIG. 2, this automatic warp threading apparatus comprises the following construction. That is, a thread feed table 3 is mounted on a stationary base 2 disposed at the side of a row of heddles adjacent a warp beam 1 to be intermittently movable sideways parallel to the row of heddles including a multiplicity of parallel heddles H, and a thread path table 4 is provided which is flat in a tangential direction of the warp beam 1, an automatic thread feeder 5 being attached to the thread table 3. On the other hand, at the opposite side of the row of heddles is a thread receiving table 7 mounted on a stationary base 6 to be intermittently movable sideways in interlocked relationship with the thread feed table 3, and a thread drawer 8 is mounted on the thread receiving table 7. The thread feeder 8 automatically clamps one warp after another arranged on the thread path table 4, moves them to the front of the eyes E of the heddles, and passes the ends of the threads through the eyes E by means of air flows from a jet nozzle (details to be described later) contained therein. The thread drawer 8 is not absolutely necessary, but a decompression device may be connected thereto for forcibly drawing the ends of the threads passed through.

In this case, it is difficult to reliably thread the warps through the eyes of the heddles only with the thread drawer having the decompression device. This is because the eyes of the heddles usually are arranged at a slight angle to the row of the heddles. Therefore, action of the jet nozzle connected to the thread feeder 8 is needed.

The heddles H are supported by an upper and a lower heddle bars 9, and are selected and fixed in threading order by a known automatic heddle selecting mechanism with the eyes E directed towards the automatic thread feeder.

One stationary base 2 and the other stationary base 6 cause the thread feed table 3 and the thread receiving table 7 mounted thereon to successively and intermittently move sideways to positions corresponding to these heddles with progress of warp threading.

The thread path table 4 is where a multiplicity of warps Y drawn from the warp beam 1 are arranged in order and wait for their turns to be threaded. A small weak clip 10 allowing easy pull-out is provided adjacent the heddles, and a large strong clip 11 is provided adjacent the warp beam. Between the two clips, a small groove 12 is provided adjacent the small clip 10 and a large groove 13 is provided adjacent the large clip 11, which extend parallel to the row of heddles, respectively. The small groove 12 is where articulate finger members (details to be described later) at a forward end of the automatic thread feeder 5 clamps the warp Y in tension, and facilitates clamping of the warp Y by the finger members Y. The large groove 13 allows the warp drooping down therein to be extended and readily pulled by the automatic thread feeder.

Figure 3:
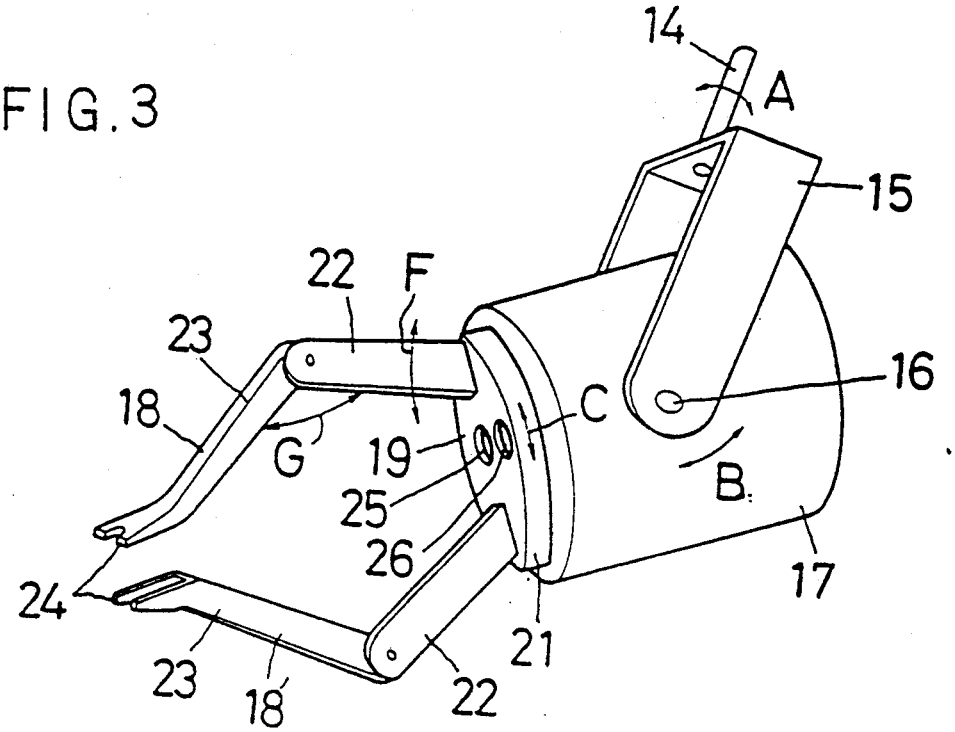
FIG. 3 and FIG. 4 are a perspective view of an automatic thread feeder and an enlarged perspective view of a principal portion thereof.
Figure 4:
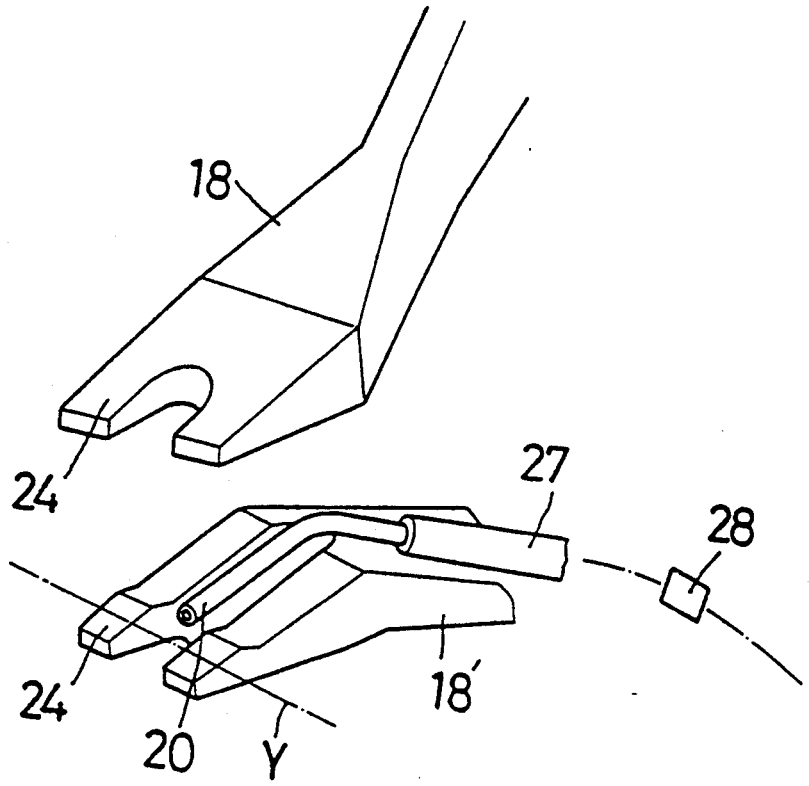

As shown in FIG. 3 and FIG. 4, the automatic thread feeder 5 comprises a universal head 17 oscillatably (see an arrow B in FIG. 3) attached through a pin 16 to a lower end of a hook-shaped arm 15 rotatable (see an arrow A in FIG. 3) on an axis 14, articulate finger members 18, 18' attached in pair to the universal head 17 for holding the warp Y, and a thread detector 19 mounted in the universal head 17 and having an optical visual function. The lower articulate finger member 18' includes an air jet nozzle 20 (see FIG. 4) for threading the warp through the eye of a heddle. This jet nozzle, however, may eject not only air but various gases (such as nitrogen, argon, and steam) according to purpose.

Further, a mechanism may be provided, in addition to the jet nozzle, adjacent the finger member for applying moisture in spray form to the warps. This will positively reduce threading errors due to fluff of the warps.

The universal head 17 has a cylindrical shape and includes various drive devices inside, to rotate about the axis 14, to oscillate about the pin 16 or to allow only an inner cylinder 21 to rotate with the finger members 18, 18' (see an arrow C in FIG. 3) in response to a command from the thread detector 19.

The articulate finger members 18, 18' comprise a first finger 22 and a second finger 23 connected to each other, with the second fingers 23 acting in response to commands from the thread detector to clasp and release the warp at. In particular, the first fingers 22 are oscillatable in the directions of arrow F in FIG. 3 relative to the universal head 17, and the second fingers 23 are oscillatable in the directions of arrow G in FIG. 3 relative to the first fingers 22. The second fingers 23 define bifurcate grip portions 24 at the distal ends, which are slightly bent to define planar abutting surfaces for tight contact.

The pair of first fingers 22 attached to the inner cylinder 21 and forming part of the finger members 18, 18' need not be disposed in linear alignment diametrically of the inner cylinder 21. The pair of first fingers 22 may be arranged to intersect at a fixed angle when the first fingers 22 are extended diametrically in order to facilitate and assure gripping of the warp at the distal ends of the second fingers 23.

The thread detector 19 is a sensor of a visual detector and control device for picking up the warp Y with a television camera or the like. The universal head 17 defines a sensing aperture 25 and an optical sensor aperture 26 of the sensor and the like in a forward end surface thereof.

The air jet nozzle 20 is disposed between the grip portions 24 and directed toward the gripped warp, which is continuous with a flexible blast pipe 27, with an electromagnetic valve 28 mounted at an intermediate position of the pipe, compressed air being ejected from a compressed air device (not shown) only at threading times.

Figure 5:
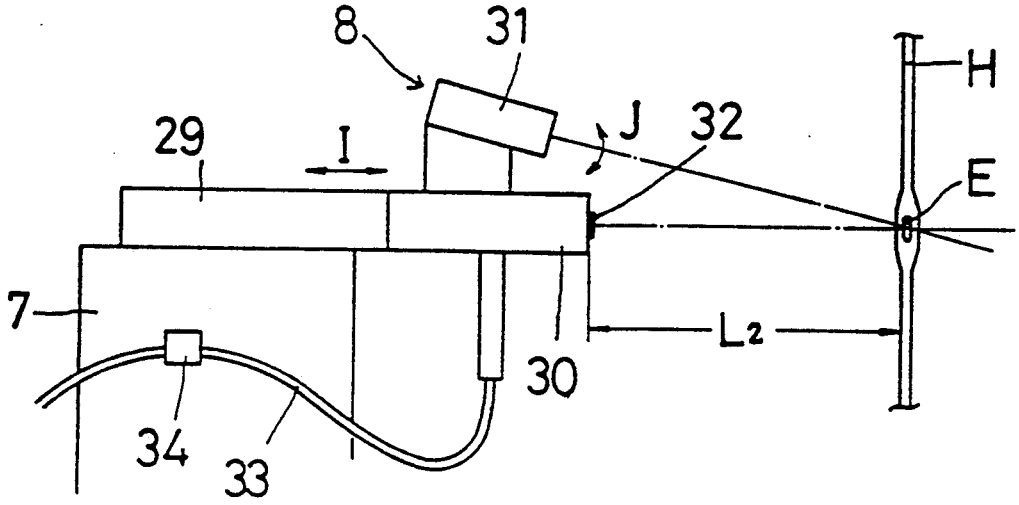
FIG. 5 is a schematic side view of an automatic thread drawer.

As shown in FIG. 5, the automatic thread drawer 8 comprises a suction nozzle 30 which is horizontally pivotable through an arm 29 extendible and contractible in the fore and aft direction (see an arrow I) on the thread receiving table 7, and a television camera 31 acting as a visual detector vertically oscillatable (see an arrow J) on the suction nozzle 30. The suction nozzle 30 defines a suction port 32 at the front thereof, and a flexible suction pipe 33 is connected thereto, with an electromagnetic valve 34 mounted at an intermediate position of the pipe, suction being applied by a vacuum device (not shown) only at the threading times.

When using the automatic warp threading apparatus according to the present invention, the multiplicity of warps Y drawn from the warp beam 1 onto the thread path table 4 are first arranged in tension on the small groove 12 and drooped in the large groove 13.

Figure 6:
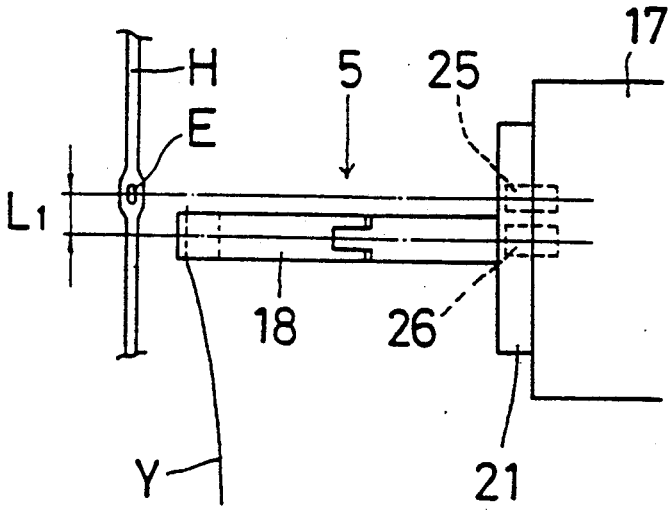
FIG. 6 is an explanatory view of a visual thread detecting operation.
Figure 7:
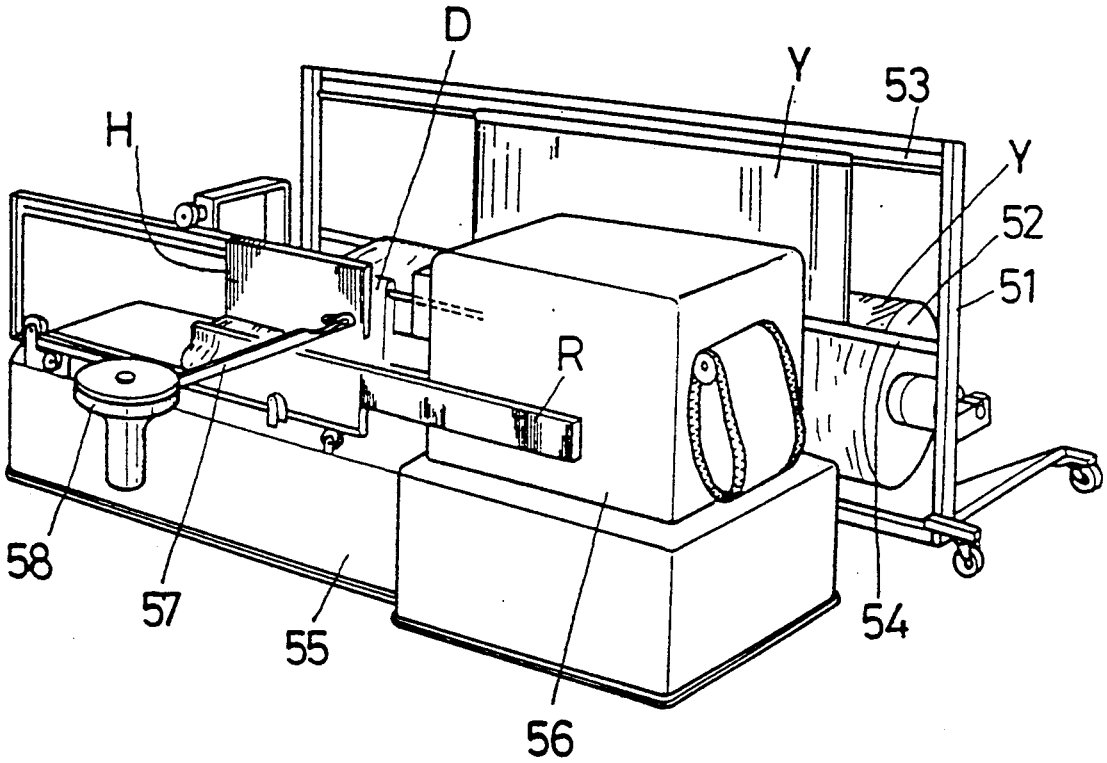
FIG.7 (PRIOR ART)
FIG. 7 is a perspective view of a prior art example.

As a second step, the automatic thread feeder 5 is driven to move the universal head 17 for allowing the light beam observed through the sensing aperture 25 to travel horizontally through the eye E of a heddle H as shown in FIG. 6, to move the warp Y held by the articulate finger member 18 toward the eye of the heddle, and at the same time to raise it by a distance L1 between the sensing aperture 25 and optical sensor aperture 26 thereby to place the end of the thread immediately in front of the eye of the heddle. No trouble occurs at this time even if the warp is pulled since the portion thereof drooping in the large groove 13 of the thread path table 4 would be extended.

As a third step, the automatic thread drawer 8 is driven to cause the optical axis of the television camera 31 to intersect the eye of the heddle on a horizontal line extending from the suction nozzle 30 for confirmation while maintaining a predetermined distance L2 between the suction port 32 and the heddle H as shown in FIG. 5, and to advance the arm 29 to place the suction port into tight contact with the eye E to be ready for drawing the thread end.

Then, air is jetted from the air jet nozzle 20, releasing the grip of the warp at the same time, and suction through the suction nozzle is started, whereby the thread end passes with air flows through the eye of the heddle to be drawn into the suction nozzle. The suction is stopped when the thread departs from inside the large groove 13, whereupon the automatic thread drawer is retracted with the drawn-in thread end emerging from the suction port.

INDUSTRIAL APPLICABILITY

As already described, the automatic warp threading apparatus according to the present invention is suited for automatically and reliably threading warps through the eyes of a multiplicity of heddles.

I claim:

1. An automatic warp threading apparatus for automatically threading warps (Y) through the eyes (E) of heddles from one side of a row of multiple parallel heddles (H), said apparatus comprising a thread path table (4), a stationary base (2), and a thread feed table (3) movable on the stationary base (2) disposed at said one side of the row of heddles, the thread feed table (3) carrying a thread feeder (5), the thread feeder (5) including finger members (18, 18') for clamping the warps (Y) arranged on said thread path table (4), and a jet nozzle (20) attached to the finger members (18, 18') for ejecting a gas between said finger members to thread said warps through said eyes.

2. An automatic warp threading apparatus as claimed in claim 1, wherein said thread feed table (3) is intermittently movable, and at the opposite side of said row of heddles is a second stationary base (6) carrying a thread receiving table (7) movable with the intermittent movement of said thread feed table (3), a thread drawer (8) being mounted on the thread receiving table (7), the thread drawer (8) including a suction nozzle, said suction nozzle effecting suction in opposed relationship to the gas ejected from said jet nozzle (20).

3. An automatic warp threading apparatus as claimed in claim 2, wherein said thread drawer (8) includes a visual detector (31) for confirming the location of the eye (H) of a heddle through which said warp (Y) is passed.

4. An automatic warp threading apparatus according to claim 1 wherein said finger members (18, 18') are in pair form for clamping the warp and are connected to said thread feeder (5) through a universal head (17) attached thereto.

5. An automatic warp threading apparatus as claimed in claim 4, wherein said universal head (17) is attached to said thread feeder (5) through a universal joint.

6. An automatic warp threading apparatus as claimed in claim 5, wherein said universal head (17) includes a thread detector (19) for visually detecting said warp (Y) to control position of said finger members (18, 18').

7. An automatic warp threading apparatus as claimed in claim 6, wherein the thread path table (4) includes a thread storing groove (13).

8. An automatic warp threading apparatus as claimed in claim 7, wherein the jet nozzle (20) ejects the gas toward said warp (Y), a mechanism being provided to apply moisture to said warp (Y).

* * * * *